US006848513B2

(12) United States Patent
Jackson et al.

(10) Patent No.: US 6,848,513 B2
(45) Date of Patent: Feb. 1, 2005

(54) FIRE PROTECTION VALVE TRIM ASSEMBLY SYSTEM

(75) Inventors: Eldon D. Jackson, Hastings, MI (US); Shawn Feenstra, Middleville, MI (US)

(73) Assignee: The Viking Corporation, Hastings, MI (US)

( * ) Notice: Subject to any disclaimer, the term of this patent is extended or adjusted under 35 U.S.C. 154(b) by 82 days.

(21) Appl. No.: 10/438,412

(22) Filed: May 15, 2003

(65) Prior Publication Data

US 2004/0011537 A1 Jan. 22, 2004

Related U.S. Application Data

(60) Provisional application No. 60/381,432, filed on May 17, 2002.

(51) Int. Cl.[7] ..... A62C 37/36

(52) U.S. Cl. ..... 169/19; 169/16; 169/17; 169/18; 169/20; 169/60; 169/61

(58) Field of Search ..... 169/5, 16, 17, 169/18, 19, 20, 22, 56, 60, 61; 137/516.25, 516.29, 523, 527.8

(56) References Cited

U.S. PATENT DOCUMENTS

| | | | | | |
|---|---|---|---|---|---|
| 306,708 | A | * | 10/1884 | Stillson | 169/19 |
| 1,914,223 | A | * | 6/1933 | Tyden | 169/17 |
| 2,265,810 | A | * | 12/1941 | Lowe et al. | 169/16 |
| 2,713,916 | A | * | 7/1955 | Muckenfuss | 169/19 |
| 2,865,457 | A | * | 12/1958 | Jensen | 169/17 |
| 3,220,483 | A | * | 11/1965 | Ludolph | 169/22 |
| 3,401,751 | A | * | 9/1968 | Loftin et al. | 169/17 |
| 5,099,925 | A | | 3/1992 | Glidden et al. | |
| 5,720,351 | A | | 2/1998 | Beukema et al. | |
| 5,971,080 | A | | 10/1999 | Loh et al. | |
| 5,992,532 | A | | 11/1999 | Ramsey et al. | |
| 6,357,531 | B1 | | 3/2002 | Asselin | |
| 2002/0003042 | A1 | | 1/2002 | Reilly | |
| 2002/0011342 | A1 | | 1/2002 | Reilly | |

* cited by examiner

*Primary Examiner*—Steven J. Ganey
(74) *Attorney, Agent, or Firm*—Van Dyke, Gardner, Linn & Burkhart, LLP

(57) ABSTRACT

A trim assembly for a fire protection system valve includes a mounting member and a piping assembly supported by the mounting member. The piping assembly includes a priming line with an inlet for receiving priming fluid from a fire suppressant fluid supply line and an outlet for delivering priming fluid to a priming chamber of the fire protection system valve. The inlet and the outlet are provided at the mounting member. The piping assembly also includes a component, which responsive to a control signal and/or a pressure differential. The component redirects priming fluid away from the outlet of the priming line in response to the control signal and/or the pressure differential for controlling the delivering of priming fluid to the priming chamber of the fire protection system valve. The piping assembly further includes a discharge outlet, with the priming line discharging the priming fluid to the discharge outlet when the component directs priming fluid away from the outlet of the priming line, which is preferably provided at the mounting member.

36 Claims, 15 Drawing Sheets

FIRE PROTECTION VALVE TRIM ASSEMBLY SYSTEM

This application claims priority from U.S. provisional application Ser. No. 60/381,432, filed May 17, 2002, entitled FIRE PROTECTION VALVE TRIM ASSEMBLY SYSTEM, by Eldon D. Jackson, the entire disclosure of which is incorporated herein by reference in its entirety.

TECHNICAL FIELD AND BACKGROUND OF THE INVENTION

The present invention relates to fire protection systems and, more particularly, to trim piping and components that control the operation of the main control valve of various fire protection systems.

Fire protection systems come in several forms. For example, deluge fire protection systems totally flood the protected area with pressurized water, with the system designed to empty until the control valve is closed by a release system, such as a hydraulic, pneumatic, electric, or manual release system. These deluge systems are often used in areas where a fire may spread rapidly or in an area that contains combustible material or solutions or the like. Other fire protection systems cycle between actuated and non-actuated states and, in some cases, only deliver water to the affected area when actuated by a heat sensor.

In some systems, the sprinkler system piping is filled with water prior to operation to permit a more rapid response. In other systems, the sprinkler piping is dry—these systems are primarily used to protect unheated structures where the system may be subject to freezing or in areas that are susceptible to water damage.

In each of these systems, the control valve that directs the flow of water to the sprinkler piping is controlled by a piping circuit or "trim piping". Trim piping varies depending on the type of system, and, further, on the size of the valve. In addition, trim piping is typically installed at the field by the contractor installing the sprinkler piping. However, the trim piping typically includes a significant number of components and, hence, is relatively complicated to install. Furthermore, trim piping includes a large number of valves and other components that require a specific orientation to assure proper control by the trim piping. It has been found that given the complexity of the trim piping, components may be incorrectly located and/or installed in reverse orientation. Thus, the trim system may not properly control the flow control valve requiring re-work or re-installation of the trim piping.

Consequently, there is a need for a simplified process to install the trim piping and, further, in a manner which would provide greater flexibility in the trip piping application so that a single trim piping application may be used on different size control valves.

SUMMARY OF THE INVENTION

Accordingly, the present invention provides simplified trim piping assembly that can be assembled remotely from the site where the fire protection system is being installed and, further, can be tested prior to installation.

In one form of the invention, a trim assembly for a fire protection system valve includes a mounting member and a piping assembly mounted to the mounting member. The piping assembly includes a priming line having an inlet for receiving priming fluid from a fire suppressant fluid supply line and an outlet for delivering priming fluid to a priming chamber of a fire protection system valve. The piping assembly also includes a component that is responsive to a control signal or a pressure differential, which controls the flow of fire protection fluid from the inlet to the outlet of the priming line in response to the input for controlling the delivering of priming fluid to the priming chamber of the fire protection system valve to thereby open the fire protection valve. In addition, the piping system includes a discharge outlet, with the priming line discharging the priming fluid to the discharge outlet when the component redirects the flow of fluid away from the outlet of the priming line. Preferably, the inlet and outlet of the priming line and the discharge outlet provided at or near the mounting member.

In one aspect, the component comprises a solenoid valve, for example, a solenoid valve that is normally closed in a non-fire condition. Furthermore, the input comprises a control signal from a control panel, which actuates the solenoid valve when a fire condition is detected. Preferably, the control system includes at least one fire or heat detector that generates a fire condition signal when a fire is detected. When the control system detects the fire condition signal, the control system generates the control signal to actuate the solenoid valve.

In other aspects, the component comprises an actuator, such as a pneumatic actuator, which is in communication with and detects the pressure in the sprinkler system piping. When the actuator detects a pressure drop in the sprinkler system, for example when a sprinkler is opened, the actuator redirects the priming fluid away from the priming line outlet to thereby open the system valve.

In another aspect, the assembly also includes a pressure operated valve, such as a pressurized shut-off valve. For example, the shut-off valve may be configured close communication between the inlet and the outlet of the priming line when the shut-off valve detects the system valve opening to provide a hydraulic latch for the fire protection system valve.

In other aspects, the trim piping includes at least one alarm connection for connecting to an external alarm device. Preferably, the alarm connection is provide generally at the enclosure wall.

According to another aspect, the mounting member comprises an enclosure with a removable cover to provide access to the trim piping in the enclosure.

In another form of the invention, a fire protection system includes a fire suppressant fluid supply, sprinkler system piping, and a fire protection system valve having an inlet in communication with the fire suppressant fluid supply and an outlet in communication with the sprinkler system piping. The fire protection valve has a priming chamber and a clapper assembly, which closes communication between the inlet and the outlet of the valve when the priming chamber is pressurized and opens communication between the inlet and the outlet of the valve when the priming chamber is depressurized to control the flow of fire suppressant fluid from the fire suppressant fluid supply to the sprinkler system piping. The fire protection system also includes a trim assembly, which comprises a mounting member and a piping assembly. The piping assembly includes a priming line, with an inlet receiving priming fluid from the fire suppressant fluid supply line and an outlet for delivering priming fluid to the priming chamber of the fire protection system valve, and a component responsive to an input, such as a control signal or a pressure differential. The component redirects priming fluid away from the outlet of the priming line in response to the input for controlling the delivery of priming fluid to the priming chamber of the fire protection system valve to thereby open the control valve. The piping assembly also includes a discharge outlet, with the priming line discharging the priming fluid to the discharge outlet when the component redirects the priming fluid away from the outlet of the priming line.

In one aspect, the mounting member comprises an enclosure with an enclosure wall. The inlet and outlet of the priming line and the discharge outlet are provided at the enclosure wall to thereby provide a compact trim assembly.

In other aspects, the component comprises a solenoid valve, which is actuated by a control panel in response to a detector detecting a fire condition. Optionally, the solenoid valve comprises a normally closed solenoid valve. In a further aspect, the component also includes a pneumatic actuator that redirects priming fluid away from the outlet of the priming line in response to a pressure drop in the sprinkler system piping, which together with the solenoid valve provide a double-interlock system.

It can be appreciated that the present invention provides a compact trim assembly that can be pre-assembled and pre-tested prior to installation in a fire protection system. These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
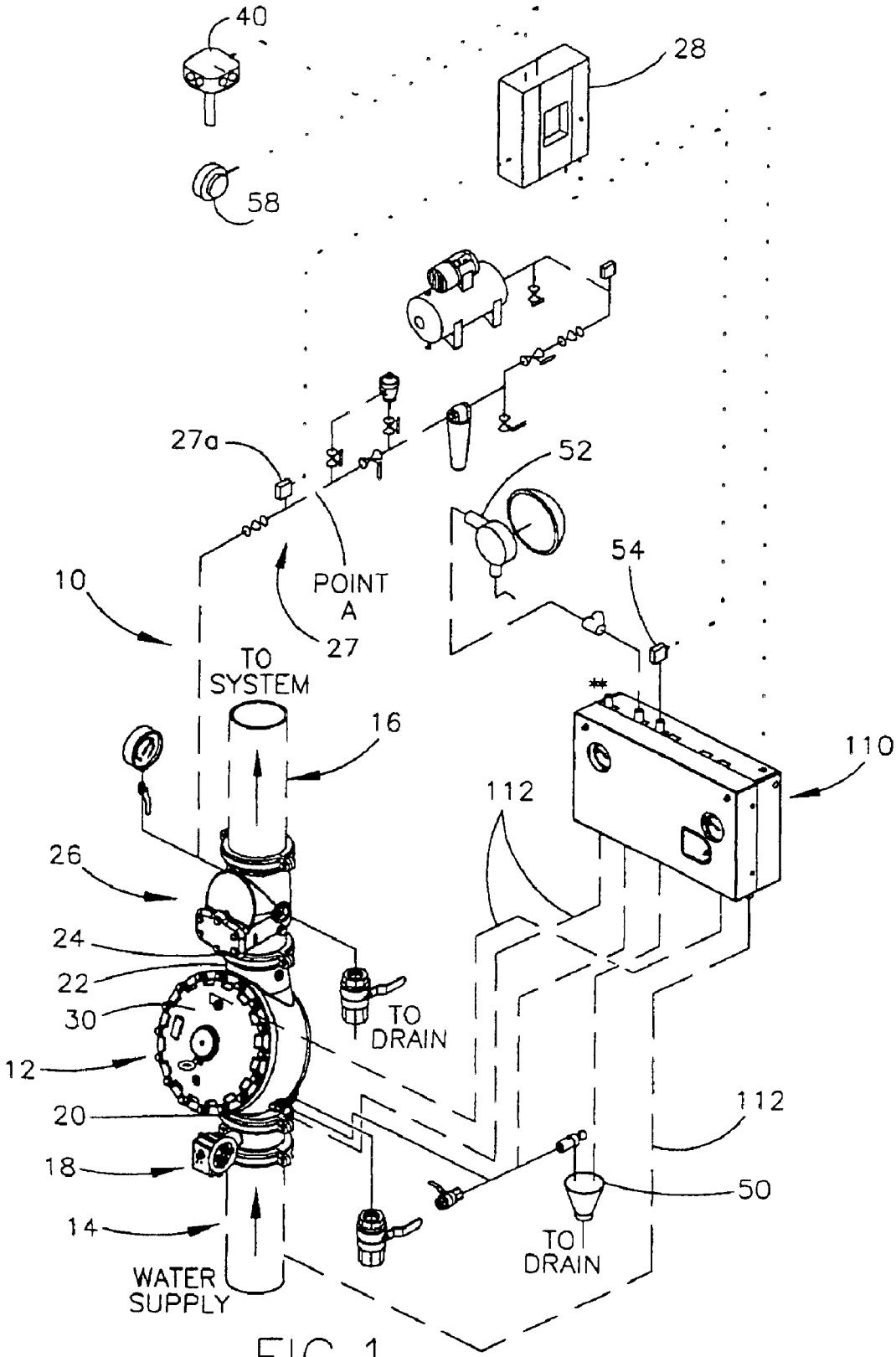
FIG. 1 is a schematic view of a pre-action fire protection system incorporating the trim assembly of the present invention that provides an electric/pneumatic release.
Figure 2:
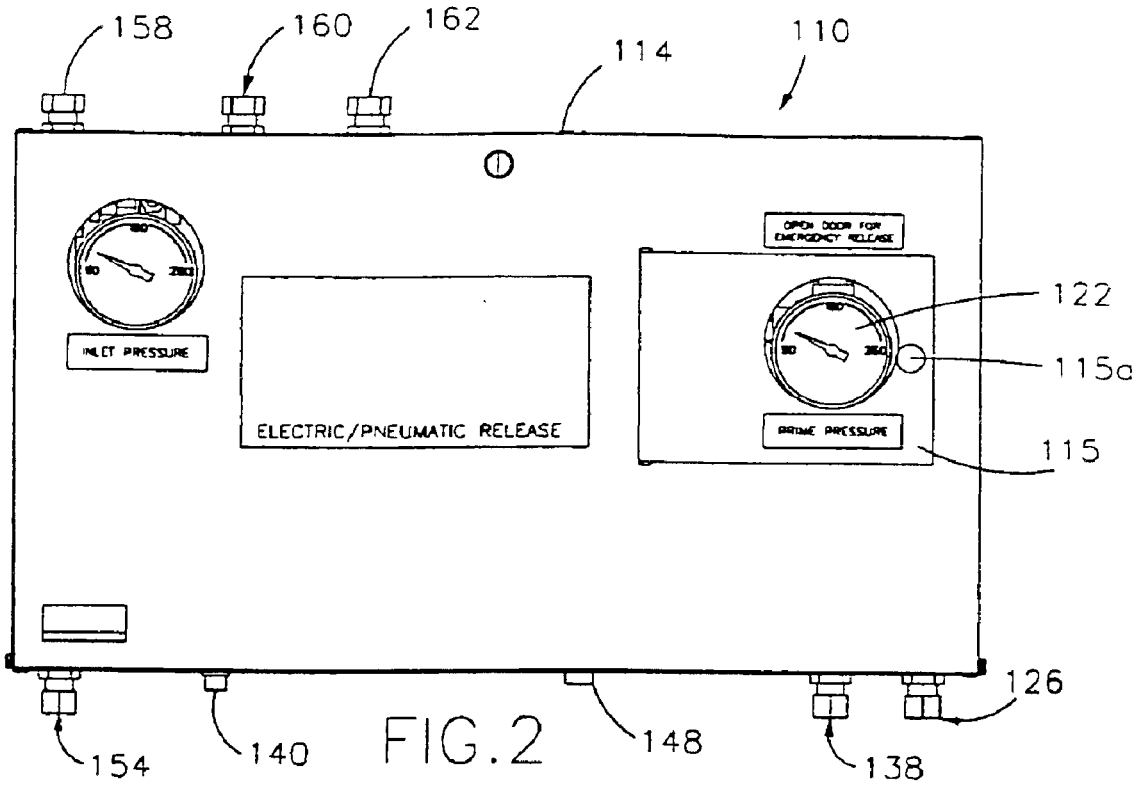
FIG. 2 is an enlarged view of the trim assembly of FIG. 1.
Figure 3:
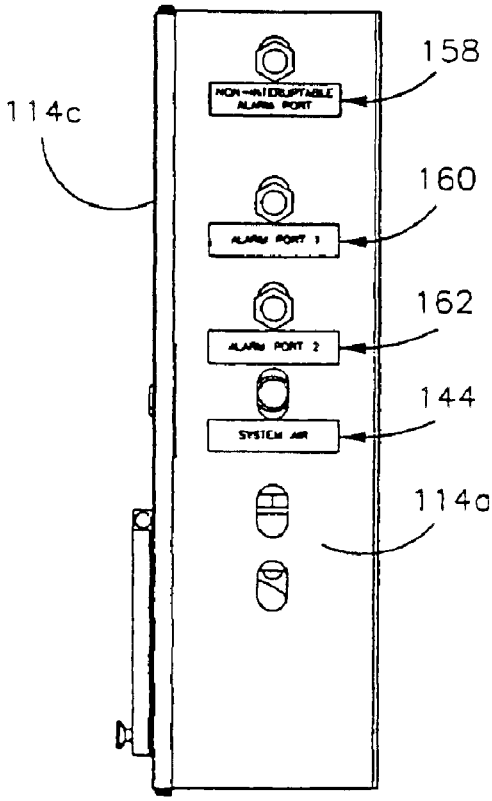
FIG. 3 is a top plan view of the trim assembly of FIG. 2.
Figure 4:
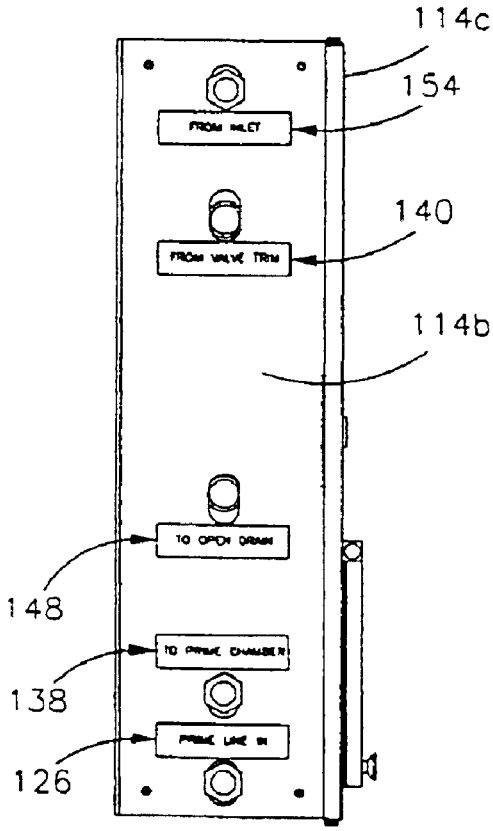
FIG. 4 is a bottom plan view of the trim assembly of FIG. 2.

Referring to FIG. 1, the numeral 10 generally designates a fire protection system incorporating a trim assembly 110 of the present invention. Fire protection system 10 includes a control valve 12, which controls the flow of fire suppressant, such as water, from a fire suppressant supply 14 to sprinkler system piping 16, which includes a plurality of sprinklers for delivering the fire suppressant to an area protected by system 10. As will be more fully described below, trim assembly 110 controls the flow of fire suppressant through valve 12 using an electric/pneumatic release. Furthermore, trim assembly 110 provides a compact assembly that is pre-assembled and pre-tested prior to installation to ease the assembly of fire protection system 10.

Fire suppressant supply 14 delivers fire suppressant to valve 12 through a water supply control valve 18, whose output delivers fire suppressant to the input 20 of valve 12. Output 22 of valve 12 delivers fire suppressant to the input 24 of a check valve 26, whose output delivers fire suppressant to system piping 16. Check valve 26 is provided to prevent the pressurized air in system piping 16 entering valve 12. System 16 is supervised with pressurized air from air system 27, which is used to monitor the pressure in fire protection system 10 to monitor the integrity of the sprinkler system piping and its components. In the illustrated embodiment, air system 27 delivers pressurized air to system piping 16 and monitors the changes in pressure in system 16 by one or more pressure switches 27*a*.

In the illustrated embodiment, valve 12 comprises a deluge valve, which includes a priming chamber 30 and a clapper assembly. The clapper assembly opens and closes communication between inlet 20 and outlet 22 of valve 12 in response to pressure in priming chamber 30, as is known in the art. Trim assembly 110 controls the pressure in priming chamber 30 and communicates with valve 12 and suppressant supply system 14 through by conduits 112, for example, flex hoses. Trim assembly 110 also communicates with a control panel 28 (via wiring indicated by dotted lines in FIG. 1), which provides actuating signals to components within trim assembly 110 and also to components located exteriorly of trim assembly 110 to control the opening of valve 12 in response to low pressure signals from pressure switch 27*a* and in response to fire-condition signals from detector 40.

Figure 5:
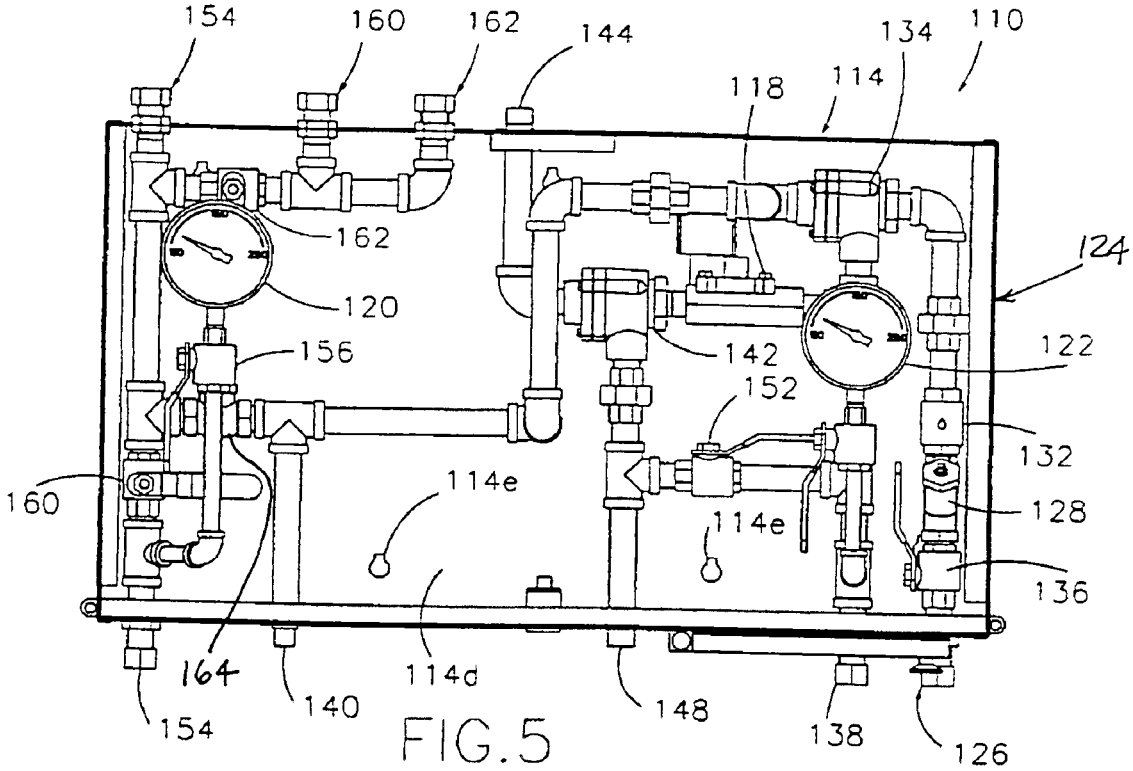
FIG. 5 is a similar view to FIG. 2 with the cover of the trim assembly removed.
Figure 6:
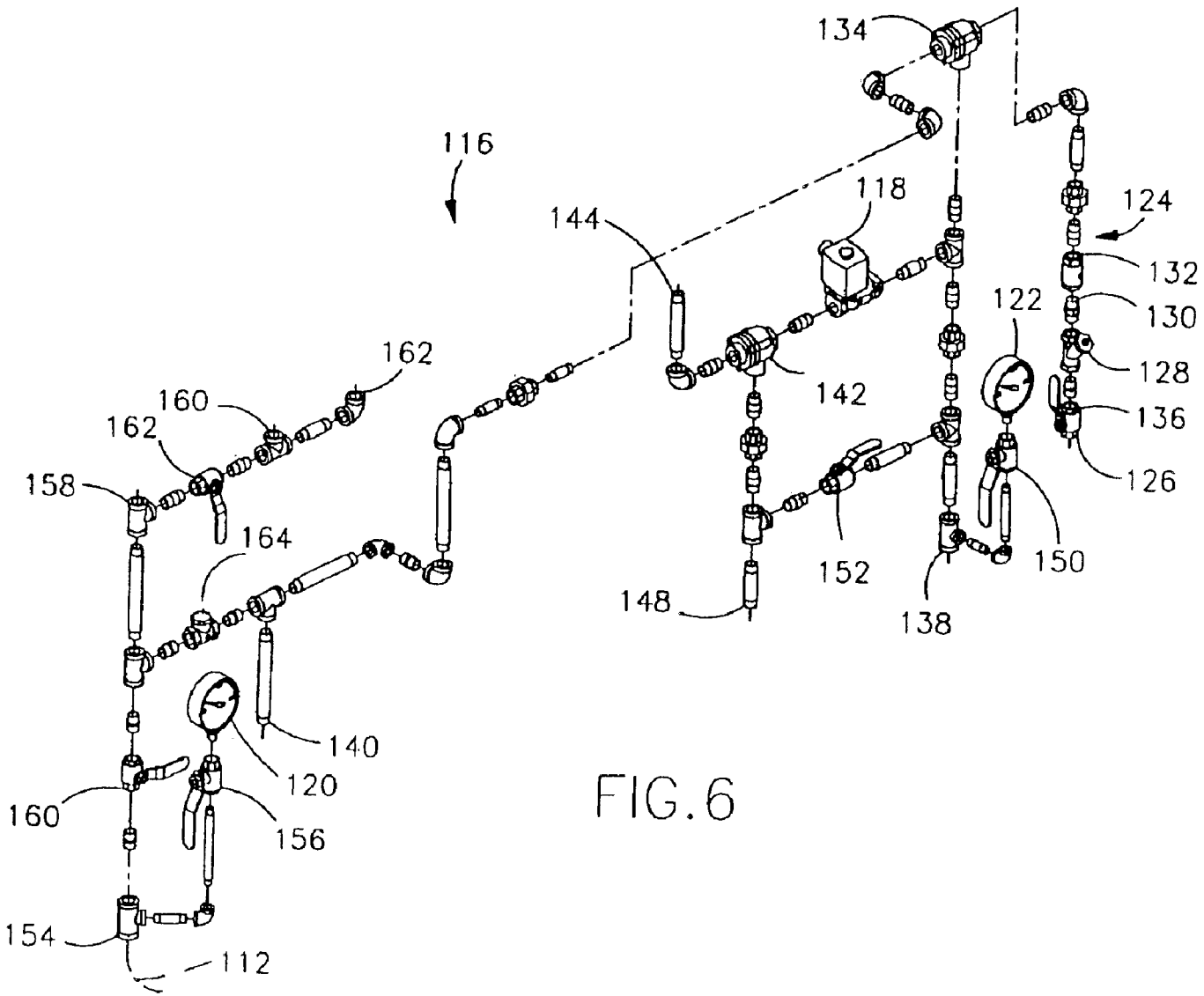
FIG. 6 is an exploded perspective view of the trim piping and components of the trim assembly illustrated in FIGS. 2–5.
Figure 7:
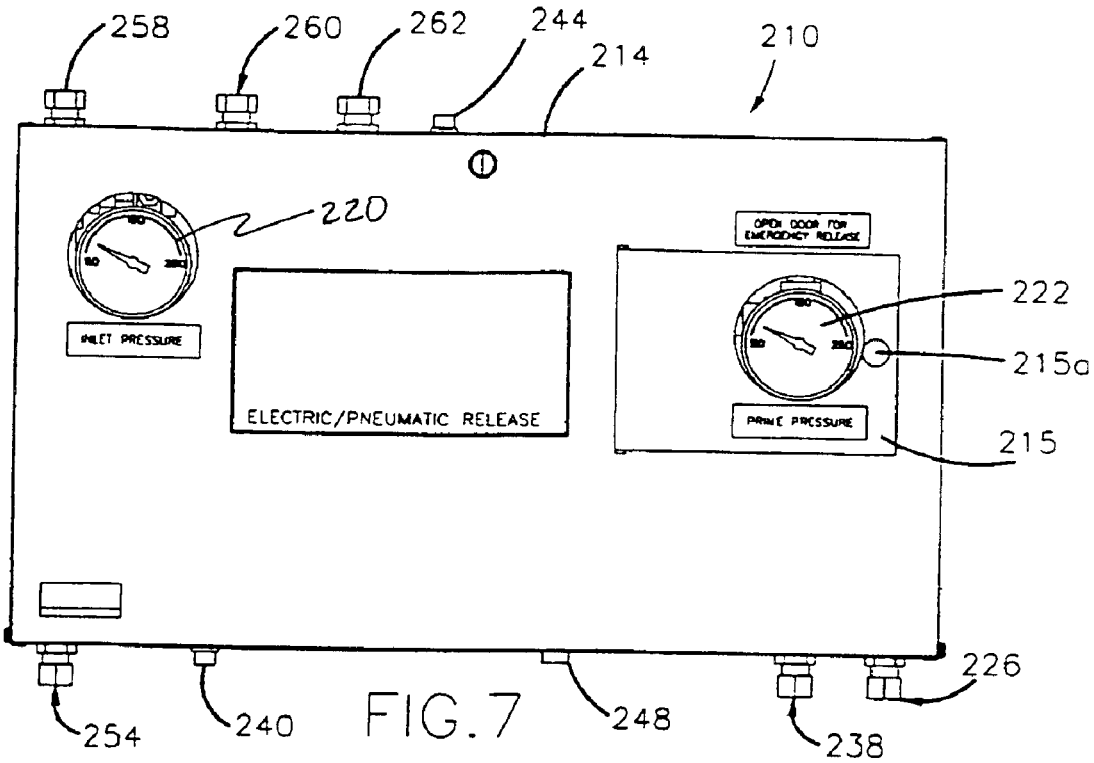
FIG. 7 is a similar view to FIG. 2 of a second embodiment of the trim assembly of the present invention, which provides a pneumatic release.

Referring to FIGS. 2–6, trim assembly 110 includes a mounting member, such as an enclosure 114, which supports and, preferably, houses trim piping (and components) 116 and provides access to various connections of trim piping 116. As best seen in FIG. 6, trim piping 116 includes a solenoid valve 118 and pressure gages 120 and 122, which provide pressure readings for the prime pressure and inlet pressure, as will be more fully described below, and a priming line 124, which delivers prime pressure to priming chamber 30 of valve 12 from the fire suppressant supply line 14 (FIG. 1) to control the position of clapper assembly 32, which opens and closes communication between inlet 20 and outlet 22 of valve 12. Priming line 124 includes an inlet 126, a strainer 128, a restriction 130, a check valve 132 all in series and which communicate with a pressure operated shut-off valve 134. Preferably, priming line 124 includes at or near its inlet a manual shut-off valve 136 so that the flow of priming fluid from supply system 14 can be blocked manually.

Pressure operated shut-off valve 134 is normally open and directs the priming pressure from priming line 124 (and hence from supply line 14) to a prime outlet 138, which is in communication with priming chamber 30 via conduit 112. To release the pressure in priming chamber 30, trim piping 116 includes solenoid 118, which is normally closed, and a pneumatic actuator 142, which is also normally closed. As generally noted above, solenoid valve 118 is in communication with control panel 28 and is actuated to open when control panel 28 receives a signal from normally open detector 40, such as heat detector, which is actuated in a fire condition. Even with solenoid valve 118 opened, however, the pressure in priming chamber 30 will not be released through solenoid valve 118 until pneumatic actuator 142 is opened. Pneumatic actuator 142 is in communication with the system piping pressure through inlet 144 and is normally closed but is opened when the sensing side of the actuator detects a drop in pressure in the sprinkler piping system. In a fire condition, when a sprinkler opens, the supervisory pressure in sprinkler piping 16 is reduced causing pneumatic actuator 142 to open. Thus, when control 28 receives a signal from detector 40 of a fire condition and one or more sprinklers open in response to a fire condition, control panel 28 actuates normally closed solenoid valve 118 to open and the pressure drop in system piping 14 opens pneumatic actuator 142 so that the pressure is released from priming chamber 30 faster than it is supplied through restricted orifice 130. When pneumatic actuator and solenoid 118 are open, the priming pressure is directed to a drain 50 (FIG. 1) through outlet 148. Where pneumatic actuator 142 is open, but solenoid 118 is not open, the pressure in priming chamber will be maintained and the system will not trip until a fire condition is also detected by detector 40. Thus, the present trim assembly provides a double interlock system.

Pressure operated shut-off valve 134 is in communication with the inlet pressure of valve 12 through inlet 140. When valve 12 opens, the sensing end of pressurized shut-off valve 134 is pressurized causing valve 134 to close. When valve 134 closes, it shuts off the flow of priming water pressure to the priming chamber 30, preventing deluge valve 12 from resetting even if the open releasing device (or devices) is closed and, thus, operates as a hydraulic latch requiring valve 12 to be manually shut-off.

As previously noted, trim assembly 110 includes a prime pressure gage 122. Prime pressure gage 122 is in selective communication with priming line 124 via valve 150. In this manner, gage 122 can be selectively actuated to test or measure the pressure in the priming line at the prime chamber outlet 138, which provides a general measure of the pressure in priming chamber 30 of valve 12. Optionally and preferably, trim piping 116 includes a manual emergency release valve 152, such as a ball valve, which provides manual release of the priming pressure in priming chamber 30 of valve 12.

Trim assembly 110 further includes an inlet pressure gage 120, which is in communication with valve 12 through conduit 112 via an inlet connection 154, which is connected to the inlet 20 of valve 12. Optionally and preferably, gage 120 is connected to inlet connection 154 by a manual valve 156, such as a ball valve, to provide selective readings of the pressure of the inlet of valve 12. Trim assembly 110 optionally provides input to an alarm pressure switch (not shown) through connection 158, which is in communication with inlet connection 154 through a manual valve 160, which is preferably normally closed. In this manner, connection 158 provides an alarm test connection for trim assembly 110. Similarly, trim assembly 110 includes a second input to a water motor alarm 52 through connection 160, which is in parallel to connection 158 and which is isolated by manual valve 162. System 110 further includes a third alarm connection 162, which communicates with a second alarm pressure switch 54, which is in turn in communication with control panel 28 and when actuated initiates control panel 28 to actuate audible alarm 58. Preferably, trim assembly 110 includes a check valve 164, which automatically drains the system after testing.

Figure 8:
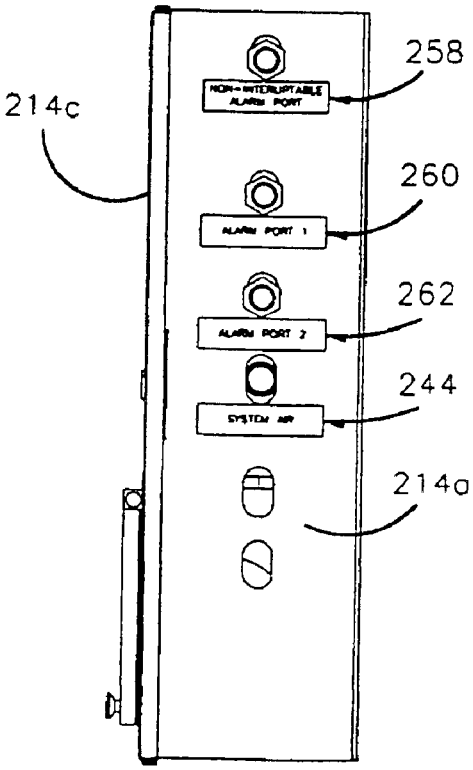
FIG. 8 is a top plan view of the trim assembly of FIG. 7.
Figure 9:
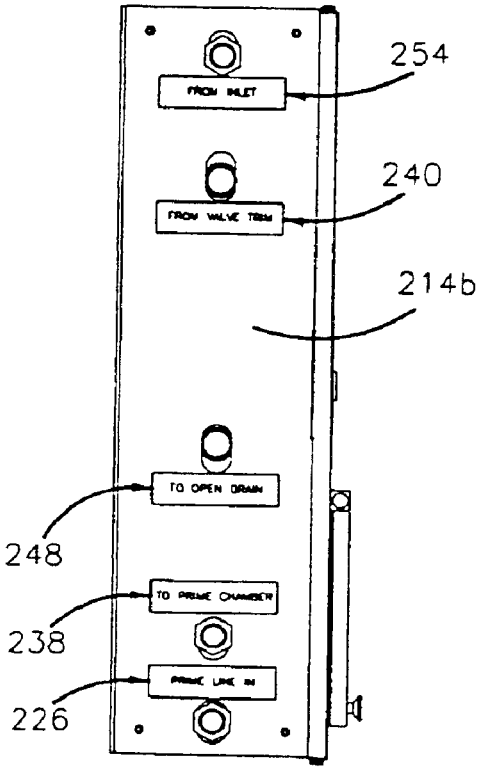
FIG. 9 is a bottom plan view of the trim assembly of FIG. 7.
Figure 11:
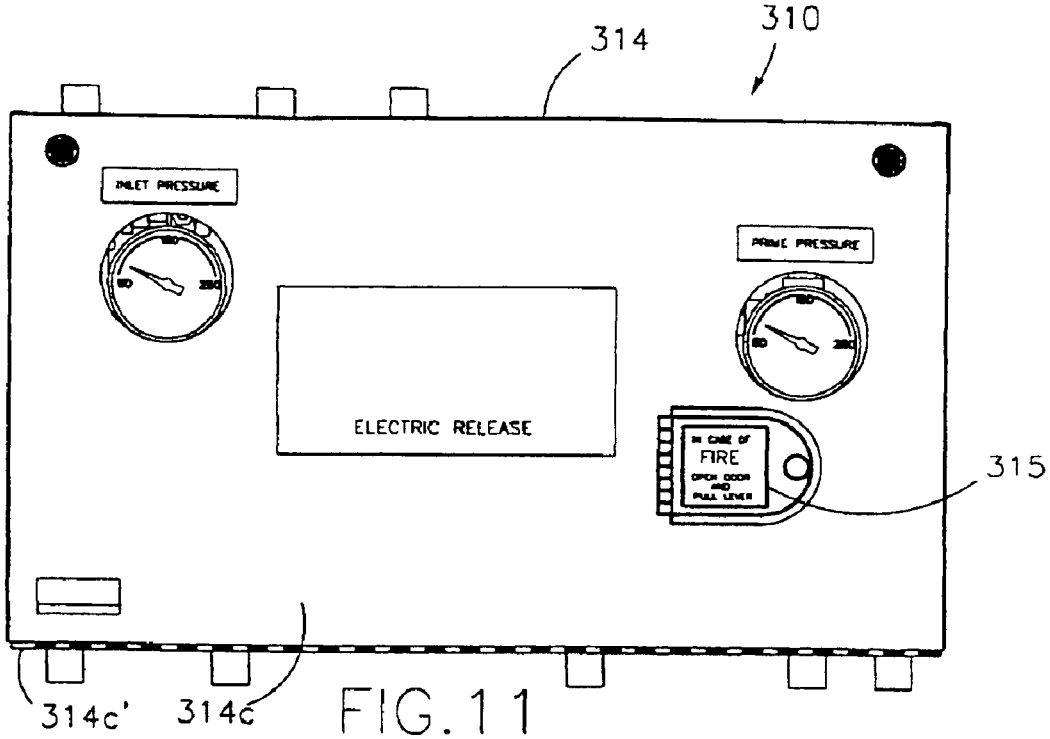
FIG. 11 is a similar view to FIG. 2 of another embodiment of the trim assembly of the present invention incorporating an electric release.
Figure 12:
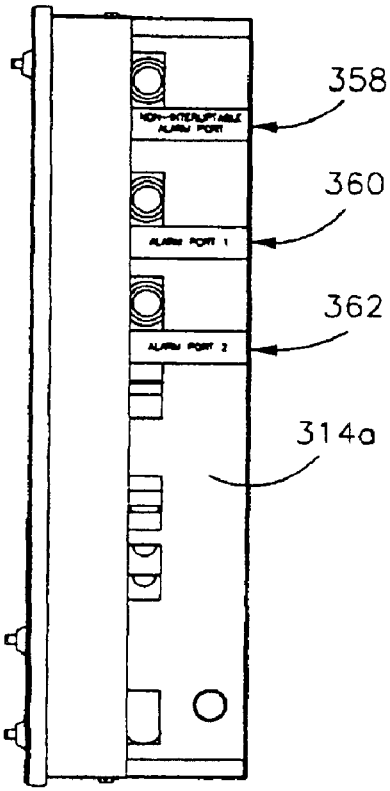
FIG. 12 is a top plan view of the trim assembly of FIG. 11.
Figure 13:
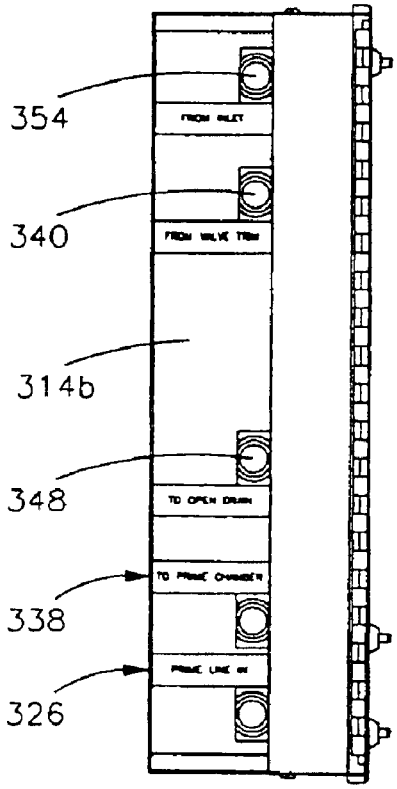
FIG. 13 is a bottom plan view of the trim assembly of FIG. 11.

Referring to FIG. 5, preferably, connections or inlets 126, 140, and 144 are accessible through enclosure 114. Similarly, outlets or connections 138, 154, 158, 160, and 162 are similarly accessible through enclosure 114 and are preferably located at upper or lower walls 114*a* or 114*b* of enclosure 114 to provide easy hook-up and connection to the various components of fire protection system 10. As best seen in FIG. 8, connections 158, 160, and 162 and outlet 144 are positioned at upper enclosure wall 114*a*, while outlets 154 and 138 (and drain outlet 148) and inlets 126 and 140 are located at lower enclosure wall 114*b*. In this manner, the various connections (inlets or outlets) are easily accessible and, further, are substantially aligned in two planes, which provides a simplified assembly that is easy to hook-up to the fire protection system and the various controls for the fire protection system. As noted above, the various connections for trim assembly 110 may be made to their respective piping components of the fire protection system by way of conduits, such as flex hoses or the like. In this manner, trim assembly 110 provides greater flexibility in the mounting of and location of the trim piping contained in trim assembly 110 and, further enables the same trim assembly piping to be used to control a wide range of valve sizes for any given fire protection system valve.

Preferably, enclosure 114 includes a removable cover 114*c* to provide access to the trim piping and components, for example the manual valves, within enclosure 114. Cover 114*c* may be pivotally mounted to any of the enclosure walls or may be slidably mounted thereon. Cover 114*c* preferably includes an emergency door 115 with a handle 115*a,* which provides quick access to the emergency release valve 152. Optionally, cover 114*c* may be eliminated in its entirety. Furthermore, a mounting member or frame may be substituted for enclosure 114. As best in FIG. 5, back wall 114*b* of enclosure 114 may include mounting openings 114*a* so that enclosure 114 may be mounted to a fixed mounting surface, such as a structure, including a wall, a column or the like.

Figure 10:
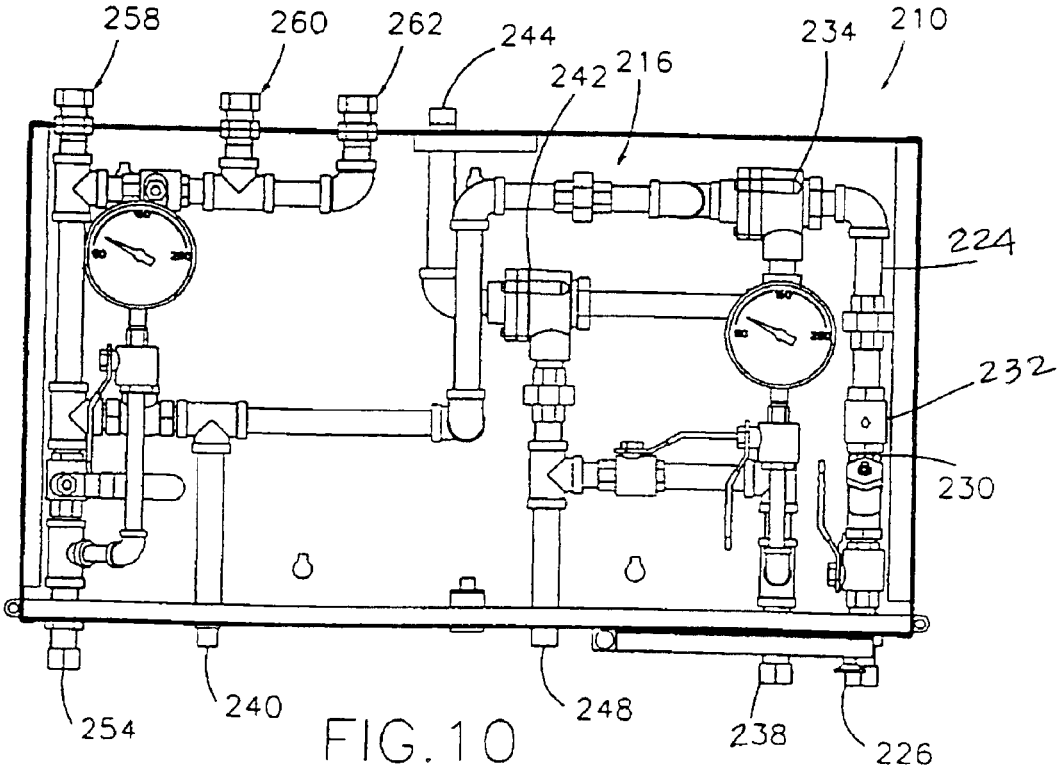
FIG. 10 is a similar view to FIG. 7 with the cover of the trim assembly removed for clarity.

Referring to FIGS. 7–10, the numeral 210 designates another embodiment of the trim assembly of the present invention. Trim assembly 210 controls the opening and closing of valve 12 using a pneumatic release. As best seen in FIG. 10, trim assembly 210 includes an enclosure 214, similar enclosure 114, trim piping (and components) 216, similar to trim piping 116, with a priming line 224 that is in communication with water supply 14 through inlet 226 and, further, in communication with priming chamber 30 of valve 12 through outlet 238. Similar to the previous embodiment, the flow of priming fluid through priming line 224 is controlled by a releasing device, namely pneumatic actuator 242, and a pressurized shut-off valve 234 that is in communication with the inlet pressure of valve 12 through inlet 240. Water supply pressure is trapped in priming chamber 30 of valve 12 by check valve 232 and pneumatic actuator 242, which is in communication with sprinkler system piping 16 through inlet 244 and detects the pressure in piping 16, similar to actuator 142. Similar to the other connections, inlet 244 is preferably provided at the enclosure wall, such as the upper wall of the enclosure.

When the sprinkler system exhibits loss of supervisory air pressure, actuator 242 opens, thus, permitting the pressure to be released from priming chamber 30 of valve 12 faster than it is supplied through restricted orifice 230 of priming line 224 in a similar manner to the previous embodiment. In addition, when valve 12 operates, the sensing end of valve 234, which is in communication with the system pressure through inlet 240, will be pressurized causing valve 234 to close. When valve 234 is closed, it shuts off the flow of priming water to priming chamber 30, preventing valve 12 from resetting even if the open releasing device (in this case actuator 242) is closed. Thus, the present trim assembly provides a single interlock system.

Similar to the previous embodiments, trim assembly 210 includes a plurality of test connections 258, 260, 262, which may be optionally coupled to alarm switches for detecting the pressure of the water supply system through connection 254, which couples to the inlet of valve 12.

Figure 14:
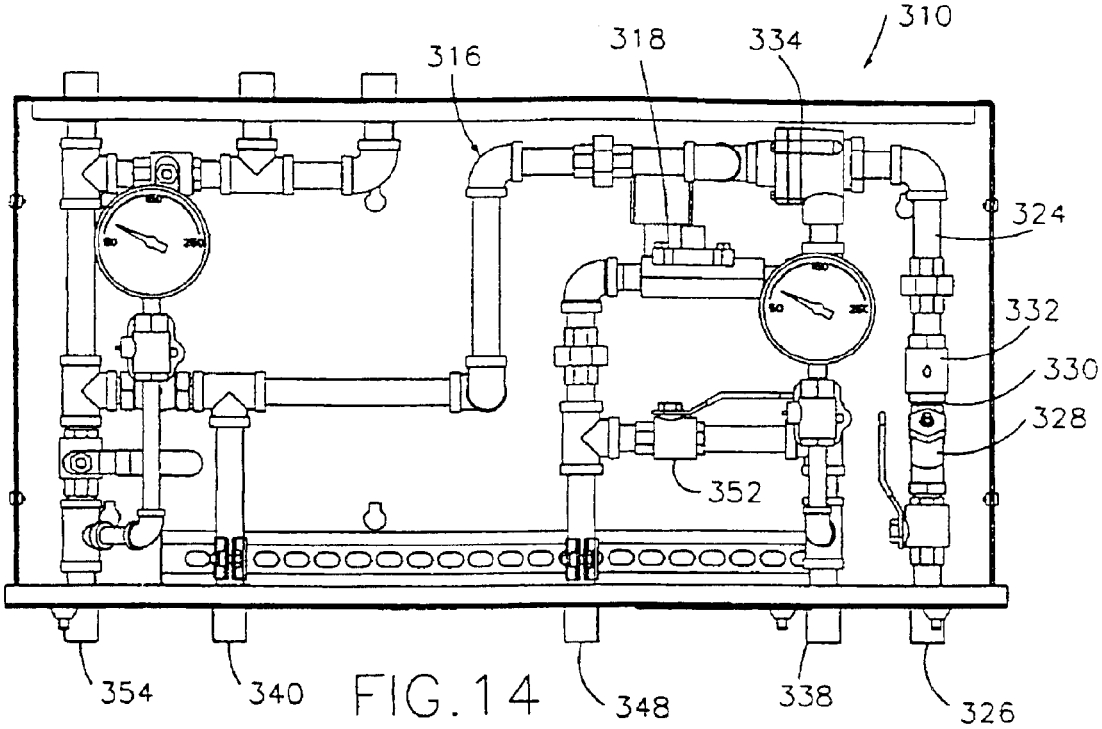
FIG. 14 is a similar view to FIG. 11 with the cover of the trim assembly removed for clarity.
Figure 19:
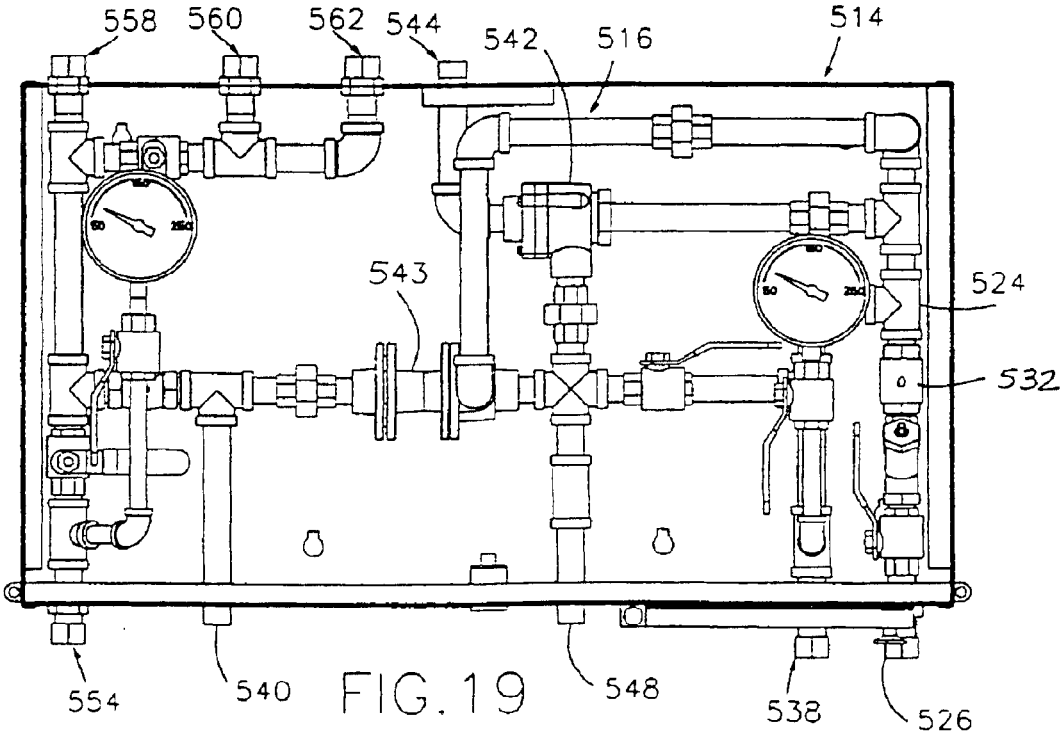
FIG. 19 is a similar view to FIG. 16 with the cover of the trim assembly removed for clarity.

Referring to FIGS. 11–14, trim assembly 310 includes an electric release for valve 12. As best seen in FIG. 14, trim assembly 310 includes an enclosure 314, similar to enclosure 114 and trim piping (and components) 316, similar to trim piping 116 of the first embodiment. In the illustrated embodiment, trim piping 316 eliminates the pneumatic actuator and, instead, provides an electric release of the priming pressure from priming chamber 30 of valve 12.

Trim piping 316 includes a priming line 324, which includes an inlet 326 that is in communication with the water supply 14, and an outlet 338 for communicating with priming chamber 30 of valve 12. Priming line 324 is similar to priming line 124 and includes a strainer 328, an orifice 330, and a check valve 332, which are all in series with pressurized shut-off valve 334. Pressurized shut-off valve 334 is normally open and directs the flow of priming fluid through outlet 338, which, as previously described, is in communication with priming chamber 30 of valve 12. Water supply pressure is trapped in priming chamber 30 by check valve 332 and a normally closed solenoid valve 318. In a fire condition, when the detection system operates, control panel 28 energizes solenoid valve 318 to open relieving the pressure from priming chamber 30 of valve 12, with the priming fluid exiting through outlet 348 to drain 50.

Similarly, once valve 12 operates, the sensing end of valve 334 is pressurized causing valve 334 to close. When valve 334 closes, it shuts off the flow of priming fluid to priming chamber 30, thus preventing valve 12 from resetting even if open releasing device is closed.

In a similar manner to the previous embodiment, test connections 358, 360, and 362 may be provided at an upper wall 314*a* of enclosure 314, while inlet and outlet connections 326, 338, 348, and 340 and 354 are provided at lower wall 314*b* of enclosure 314. In the illustrated embodiment, cover 314*c* of enclosure 314 is pivotally mounted to bottom wall 314*b* of enclosure 314 by a hinge 314*c*' to provide access to trim piping 316. Similarly, cover 314 preferably includes a door 315 that is pivotally mounted to cover 314 to provide access to emergency manual release 352, similar to the previous embodiments.

Figure 15:
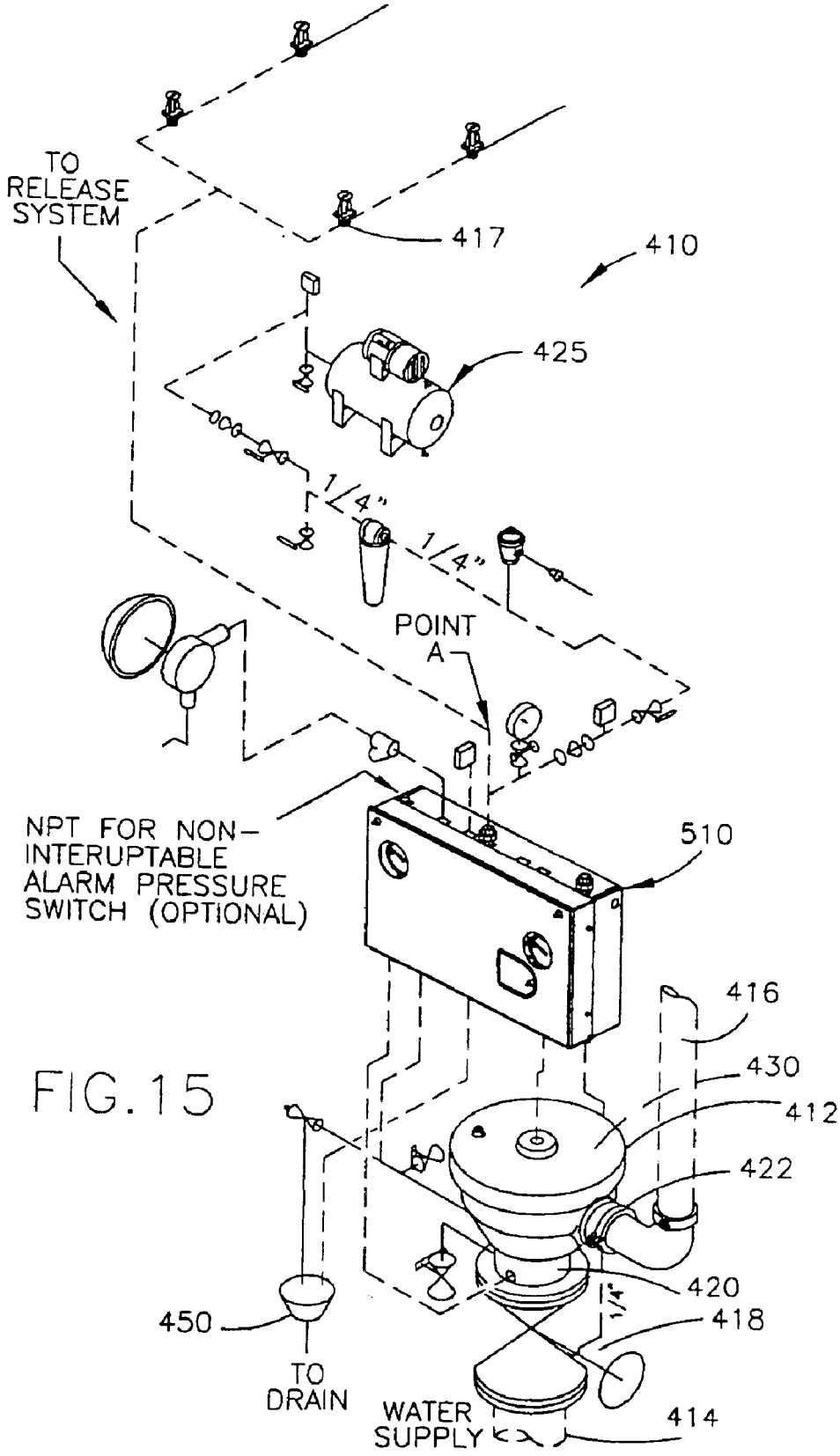
FIG. 15 is a schematic view of a deluge fire protection system incorporating a trim assembly of the present invention, which provides a pneumatic release.
Figure 16:
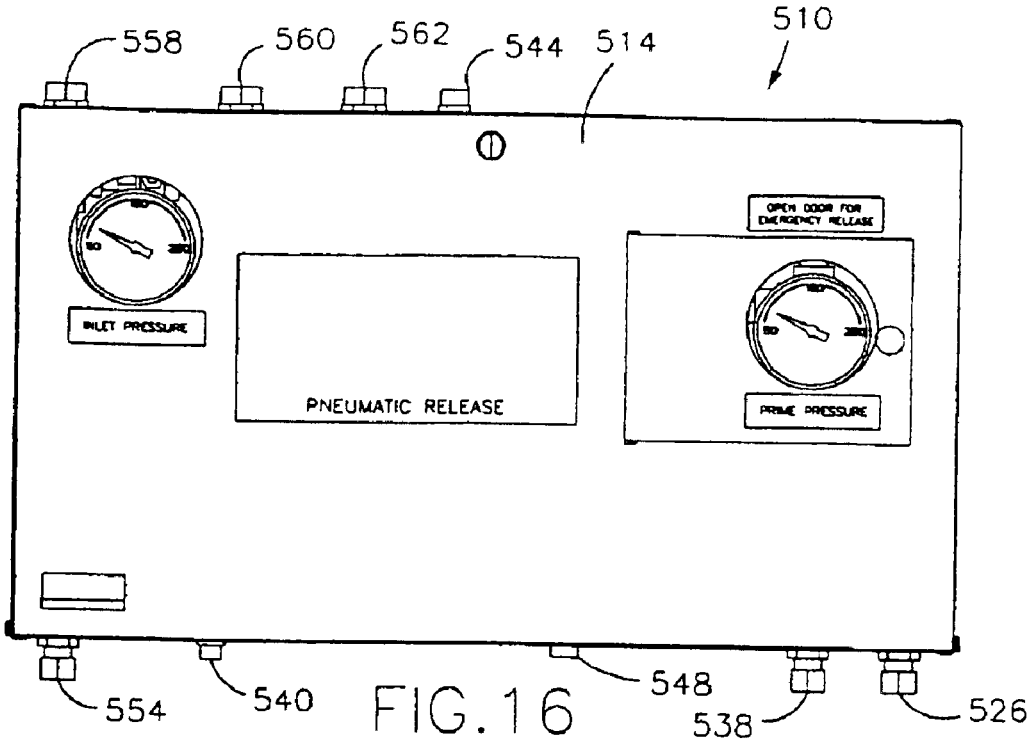
FIG. 16 is an enlarged view of the trim assembly of FIG. 15.
Figure 17:
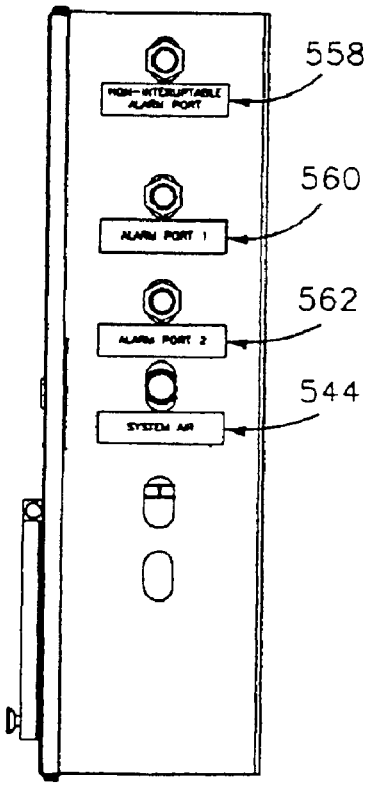
FIG. 17 is a top plan view of the trim assembly of FIG. 16.
Figure 18:
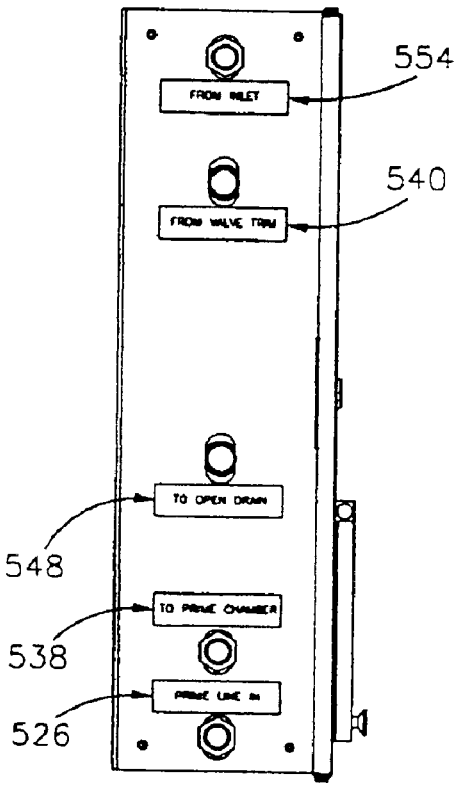
FIG. 18 is a bottom plan view of the trim assembly of FIG. 16.
Figure 20:
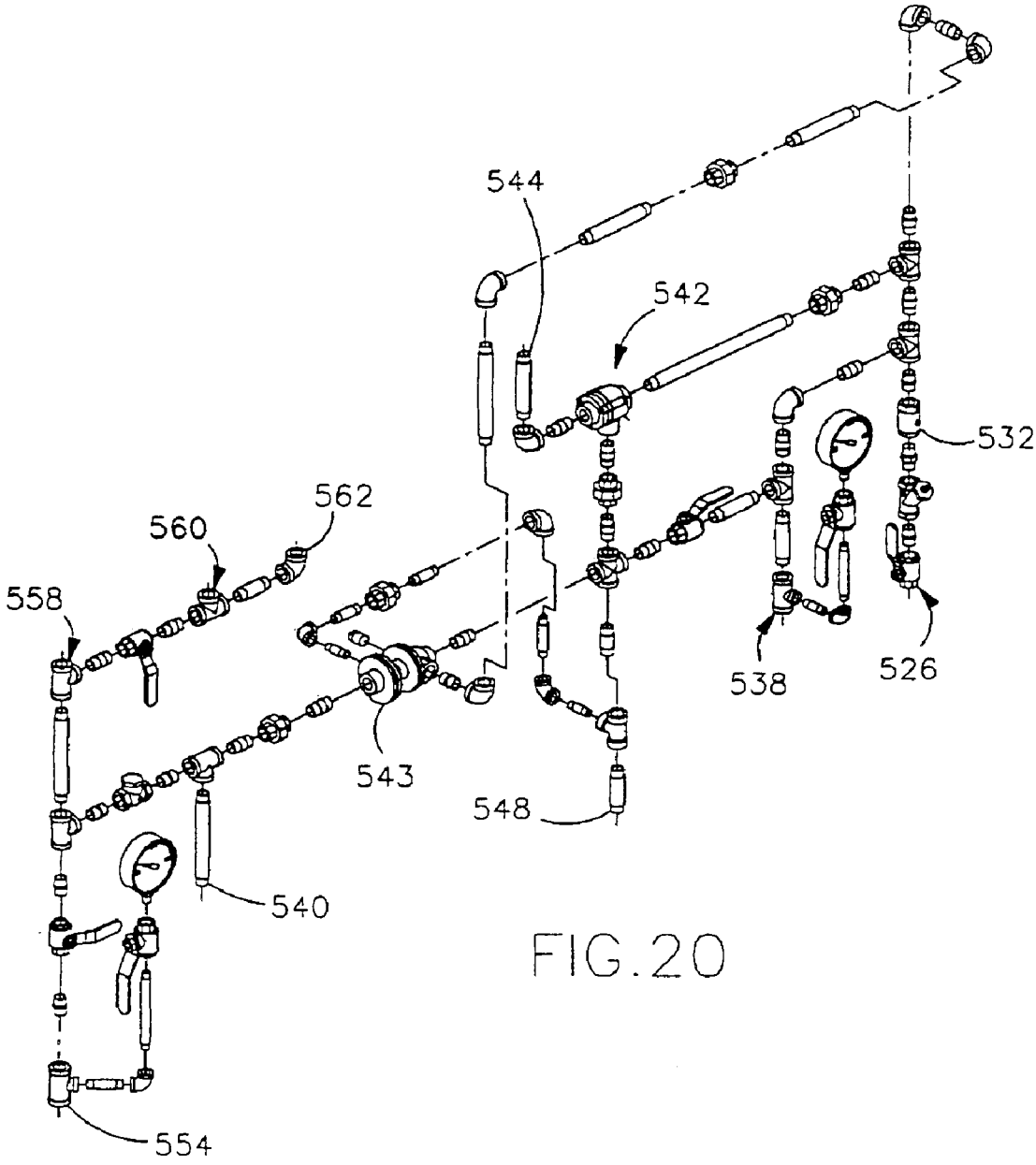
FIG. 20 is an exploded perspective view of the trim piping and components of the trim assembly of FIGS. 16–19.
Figure 21:
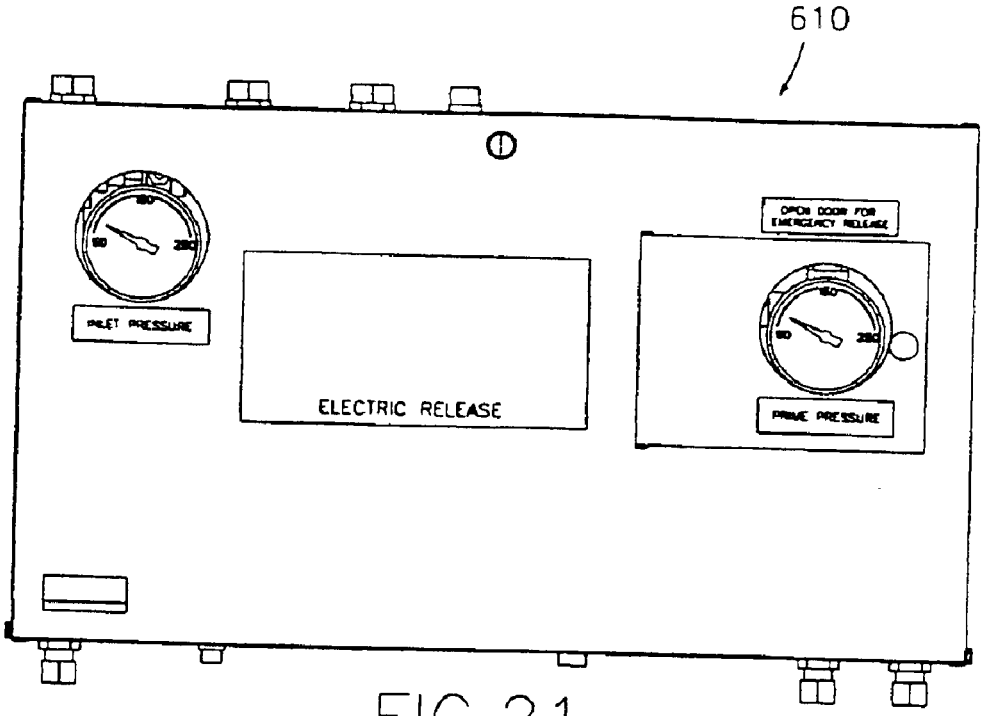
FIG. 21 is a similar view to FIG. 16 illustrating a trim assembly incorporating an electric release.
Figure 22:
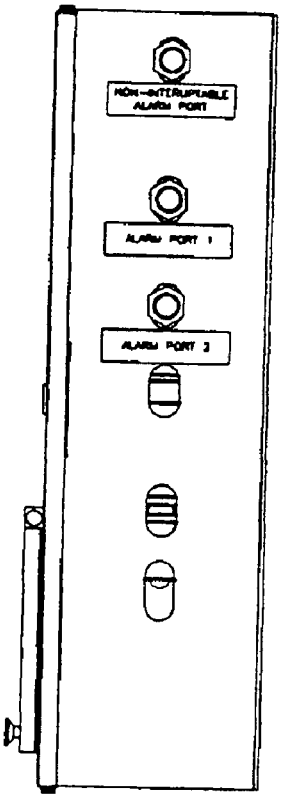
FIG. 22 is a top plan view of the trim assembly of FIG. 21.
Figure 23:
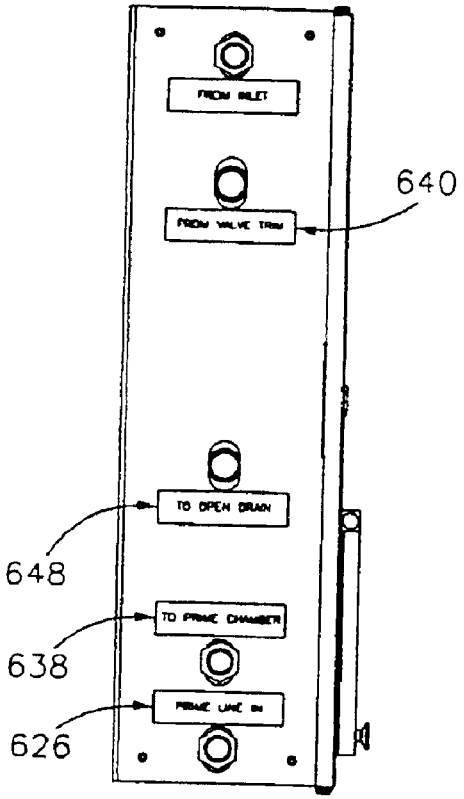
FIG. 23 is a bottom plan view of the trim assembly of FIG. 21.

Referring to FIG. 15, the numeral 410 generally designates another embodiment of a fire protection system incorporating a trim assembly 510 of the present invention. Fire protection system 410 includes a control valve 412 that controls the flow of fire suppressant, such as water, from water supply 414 to fire protection system piping 416, which in turn delivers the fire suppressant to sprinklers 417. Inlet 420 of valve 412 is in communication with the outlet of a water supply valve 418, with outlet 422 of valve 412 directing the flow of the fire suppressant to system piping 416.

Similar to the previous system, valve 412 is a deluge valve and includes a priming chamber 430 and a clapper assembly (not shown) that opens and closes communication between inlet 420 and outlet 422 in response to pressure in priming chamber 430. The control of the pressure and priming chamber 430 is achieved by trim assembly 510, which in the illustrated embodiment, provides a pneumatic release for the pressure in priming chamber 430, as will be more fully described below.

Similar to the previous embodiments, fire protection system 416 is supervised by air, which is delivered by an air supply system 425 that delivers air through a plurality of valves (which are not described in greater detail herein as they are conventional), which deliver pressurized air to system 416 and which monitor the pressure in system 416 and, further, provide input to trim assembly 510.

Referring to FIGS. 16–20, trim assembly 510 includes trim piping (and components) 516 that are housed in an enclosure 514, similar to the previous enclosures. Trim piping 516 has a number of components in common with the trim piping of the previous embodiments and includes a priming line 524 that includes an inlet 526, which is in communication with water supply 414, and an outlet 538, which is in communication with priming chamber 430 of valve 412. In a set condition, the fire suppressant supply pressure is trapped in priming chamber 430 by check valve 532, an actuator 542, and normally closed pressure operated release valve 543. Pneumatic actuator 542 is in communication with the supervisory system air through inlet 544, which connects to the air supply system 425, and opens when actuator 542 detects a pressure drop so that priming fluid will be discharged to drain 450 through discharge outlet 548.

Pressure operated release valve 543 is in communication with the system pressure through inlet 540. When valve 12 operates, the sensing end of pressure operated release valve 543 is pressurized, and pressure operated release valve 543 will operate to continually vent the priming chamber to drain 450 to prevent valve 12 from resetting even if open releasing device is closed. In this manner, valve 12 can only be reset after the system is taken out of service and the outlet chamber of valve 12 and associated trim piping are depressurized and drained. It can be appreciated that trim assembly 510 operates in the event of air supply failure and leakage of air from pneumatic release system. If air supply is not restored to the pneumatic release system, pneumatic actuator 542 will open venting the priming pressure from priming chamber 430 of valve 412 to thereby open valve 412.

Trim assembly 510 preferably includes similar test connections 558, 560, and 562, which communicate with the inlet pressure of valve 512 via inlet connection 554 similar to the previous embodiments.

Figure 24:
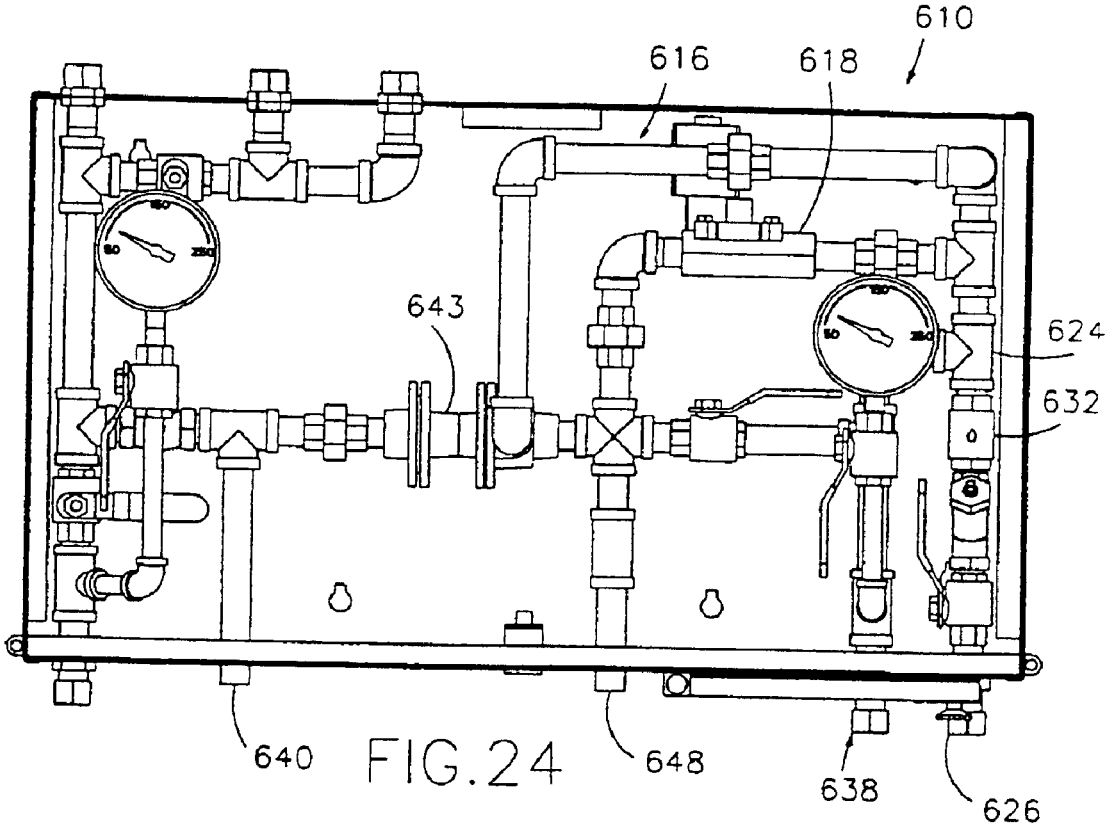
FIG. 24 is a similar view to FIG. 21 with the cover of the trim assembly removed for clarity.
Figure 29:
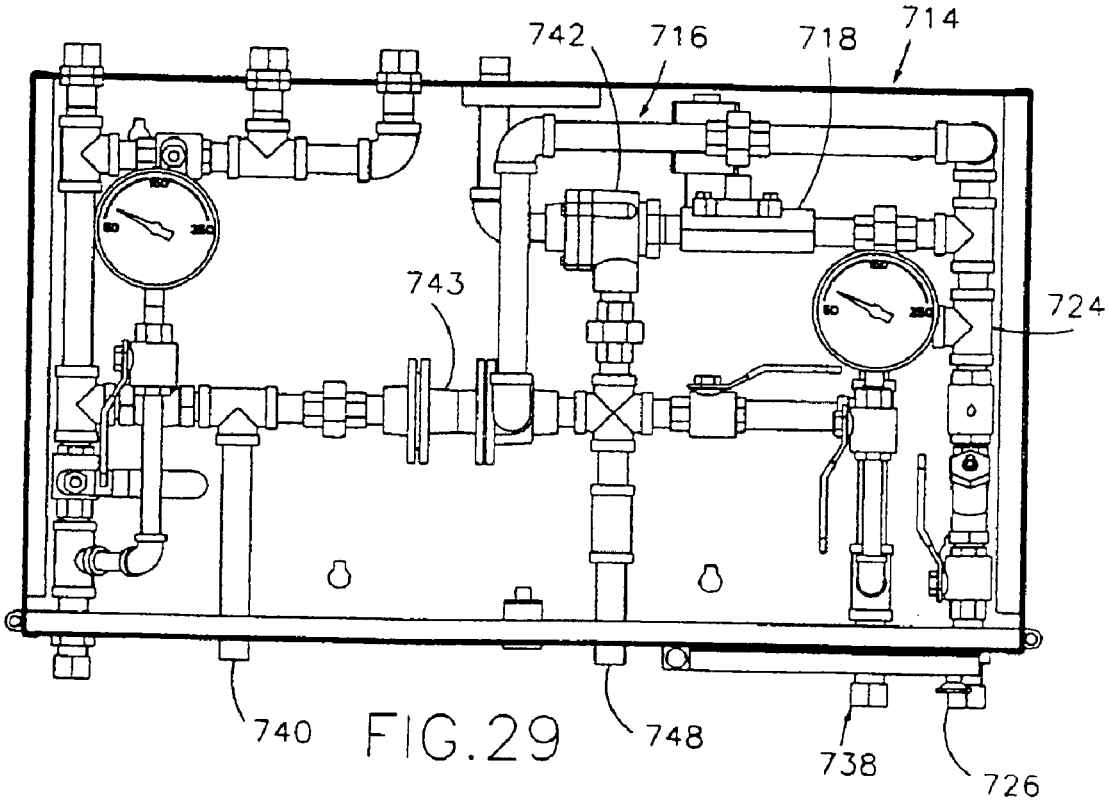
FIG. 29 is a similar view to FIG. 26 illustrating the trim assembly with the cover removed for clarity.
Figure 25:
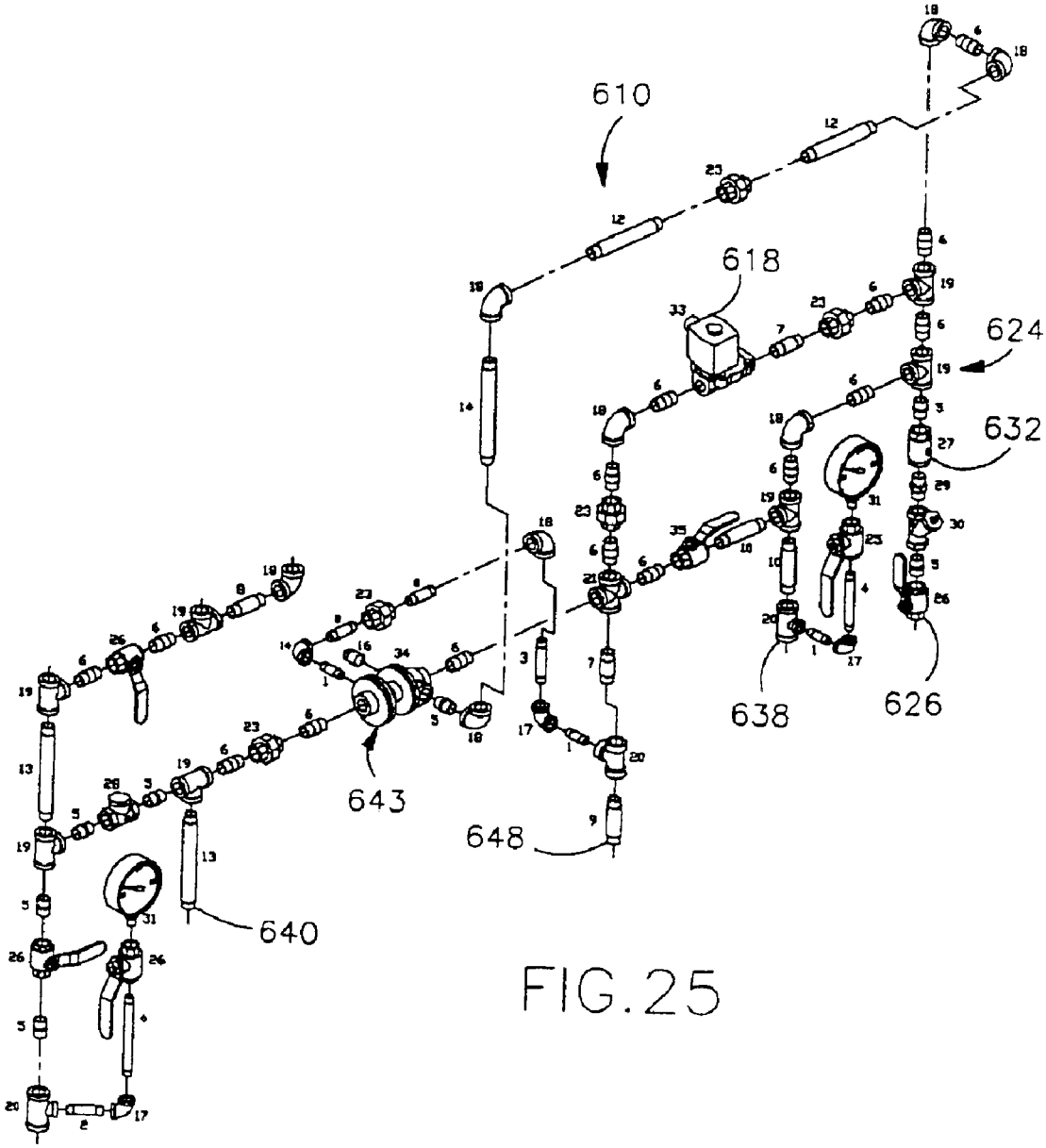
FIG. 25 is an exploded perspective view of the trim piping and components of the trim assembly of FIGS. 21–24.
Figure 26:
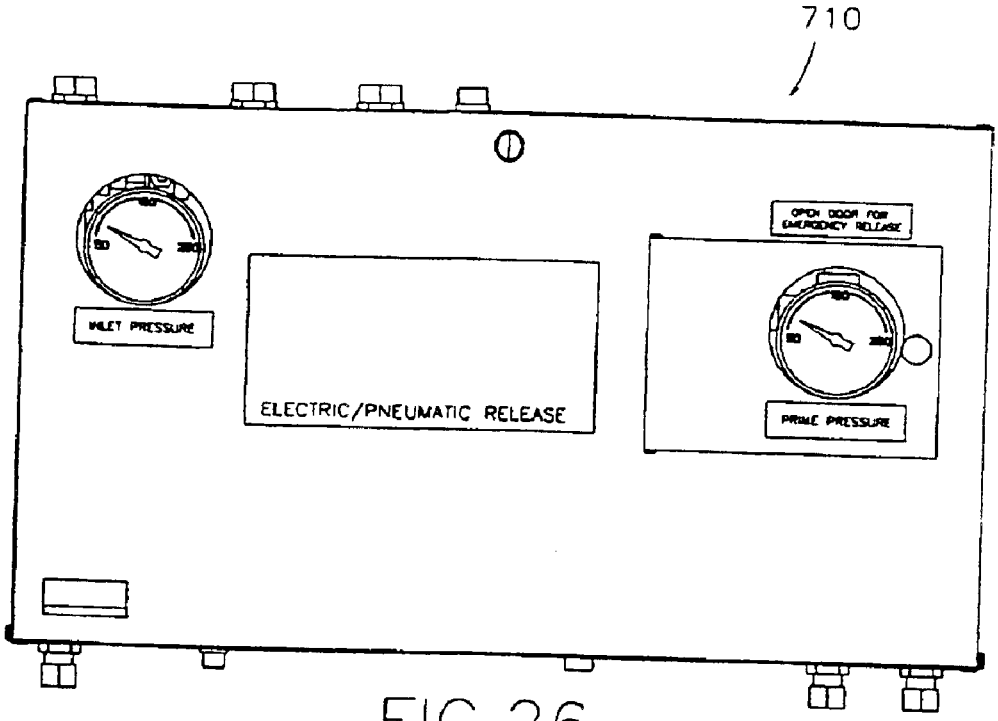
FIG. 26 is a similar view to FIG. 21 illustrating another embodiment of the trim assembly of the present invention incorporating an electric/pneumatic release.
Figure 27:
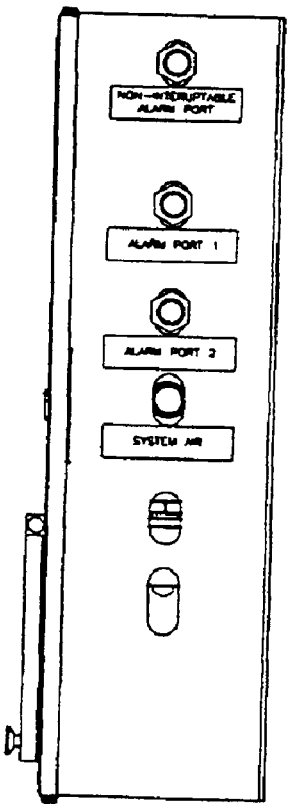
FIG. 27 is a top plan view of trim assembly of FIG. 26.
Figure 28:
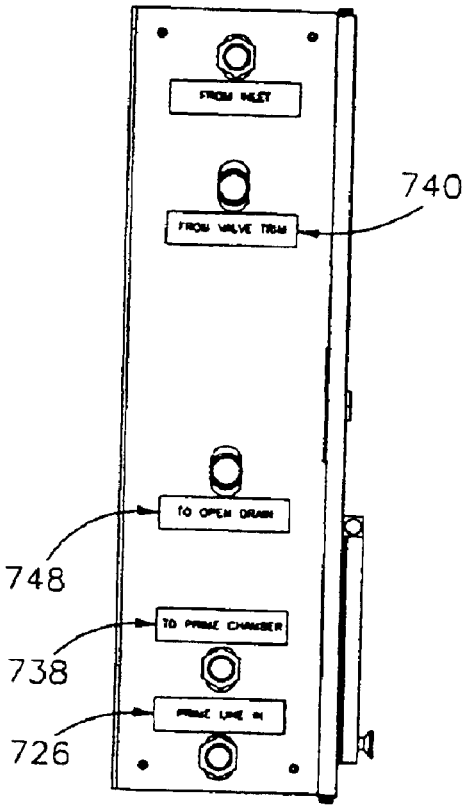
FIG. 28 is a bottom plan view of the trim assembly of FIG. 26.
Figure 30:
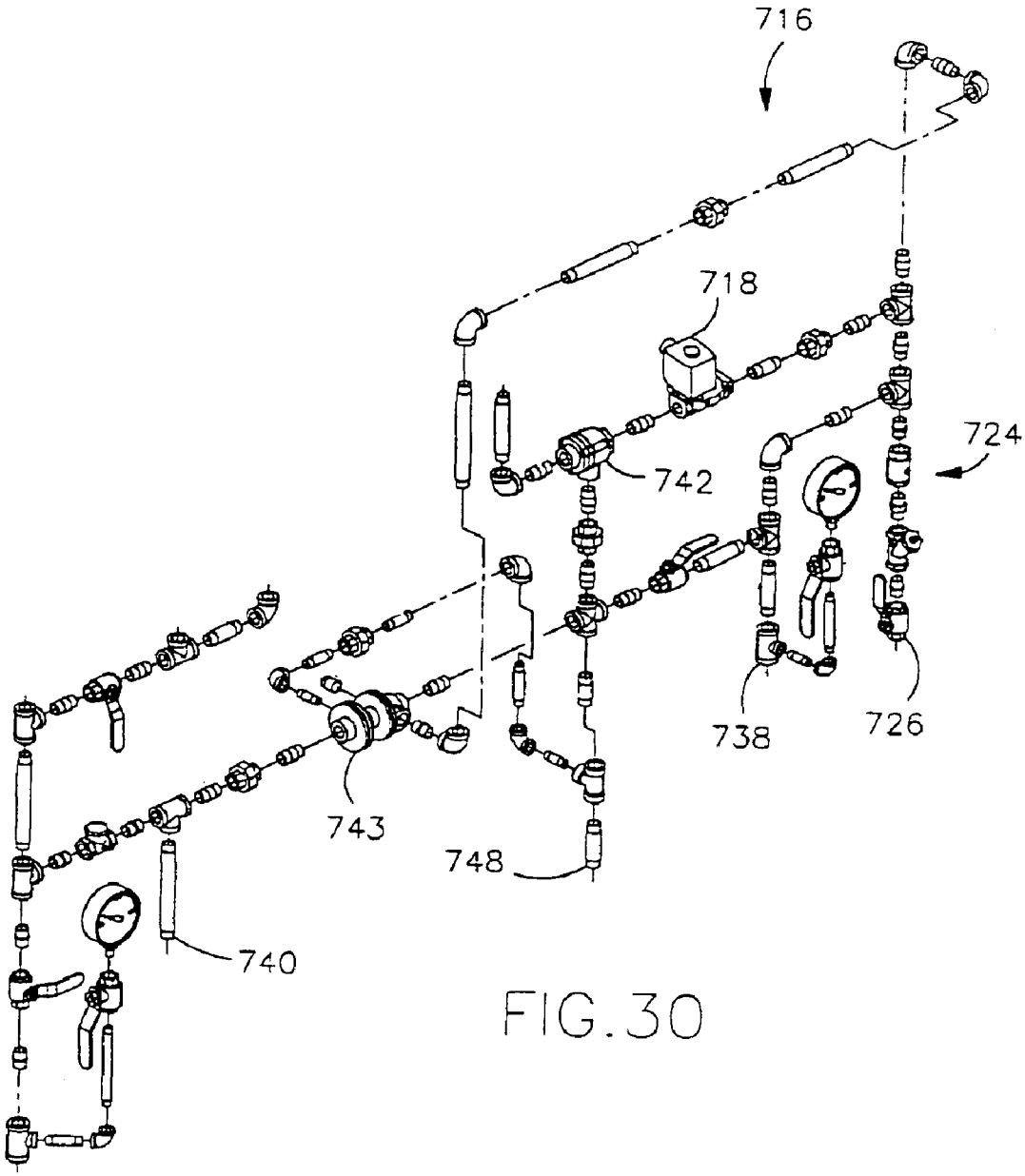
FIG. 30 is an exploded perspective view of the piping and components of the trim assembly of FIGS. 26–29.

Referring to FIGS. 21–24, another embodiment 610 of the trim assembly of the present invention is illustrated. Trim assembly 610 is similar to trim assembly 510 and includes many common components with trim piping 516 but includes an electric release for valve 412. Referring to FIG. 24, trim piping 616 of trim assembly 610 includes a priming line 624, which communicates with the water supply 414 through inlet 626 and delivers priming pressure to priming chamber 430 of valve 412 through outlet 638. Priming pressure is maintained in priming chamber 430 by check valve 632, normally closed solenoid 618, and by normally closed pressure operated release valve 643. For further details of the alarm connections, reference is made to the previous embodiments.

When a fire condition is detected by a detector (not shown but similar to detector 40), a control panel (similar to control panel 28) will open normally closed solenoid valve 618 to relieve the priming pressure from priming chamber 430 of valve 412 and direct the flow of priming fluid to drain 450 through outlet 648. When valve 412 operates, the sensing end of pressure operated release valve 643 is pressurized causing valve 643 to operate and to discharge priming fluid from priming chamber 430 to drain 450 through outlet 640, which prevents valve 412 from resetting even if the open releasing device is closed.

Referring to FIGS. 26–30, the numeral 710 generally designates another embodiment of the trim assembly of the present invention, which provides an electric/pneumatic release of valve 412. Trim assembly 710 includes trim piping (and components) 716 which are housed in an enclosure 714, similar to the previous embodiments. Trim piping 716 includes a combination of components included in trim assemblies 510 and 710. Trim piping 716 includes a priming line 724, which directs priming fluid from water supply 414 to priming chamber 430 of valve 412, and controls the flow of priming fluid by a normally closed solenoid valve 718 and a pneumatic actuator 742. Pneumatic actuator 742 is in communication with the supervisory air system 425 and opens in response to a drop in pressure in the supervisory air system, which is indicative of a sprinkler opening in response to a fire, for example, as noted above. However, priming pressure is not discharged or relieved from priming chamber 430 until solenoid valve 718 is opened. Solenoid valve 718 opens in response to signals from a control panel (such as control panel 28), which is in communication with detectors, such as detector 40. Thus, valve 412 will not open until both the electric detection system activates solenoid valve 718 and supervisory pressure in sprinkler system 416 has been lost. Similarly, once valve 412 has been opened, pressure operated release valve 743 opens to vent the priming chamber to drain 450 through outlet 740 and further remains open, preventing valve from resetting until it is manually reset.

While several forms of the invention have been shown and described, other forms will now be apparent to those skilled in the art. For example, while several forms of the trim piping have been illustrated, it should be understood that these are just exemplary and are not intended to limit the scope of this invention. Furthermore, while trim assembly has been illustrated with an enclosure, the various trim piping and connections can be mounted on a frame or other support or a planar mounting member, with the various inlets and outlets or connection provided at or near the mounting member while still providing a compact assembly that can be pre-assembled and pre-tested prior to installation at the fire protection system site. Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

The embodiments of the invention in which an exclusive property right or privilege is claimed are defined as follows:

1. A trim assembly for a fire protection system valve, the fire protection system valve having an inlet in communication with a fire suppressant fluid supply line and an outlet in communication with sprinkler system piping, the fire protection valve having a priming chamber and a clapper assembly, the clapper assembly closing communication between the inlet and the outlet when the priming chamber is pressurized and the clapper assembly opening communication between the inlet and the outlet when the priming chamber is depressurized to control the flow of fire suppressant fluid from the fire suppressant fluid supply line to the sprinkler system piping, said trim assembly comprising:

a mounting member;

a trim piping assembly mounted to said mounting member, said trim piping assembly comprising:

a priming line having an inlet for receiving priming fluid from the fire suppressant fluid supply line and an outlet for delivering priming fluid to the priming chamber of the fire protection system valve;

at least one component responsive to an input chosen from a control signal and a pressure differential, said component controlling the flow of the priming fluid between said inlet and said outlet of said priming line in response to said input for controlling the delivering of priming fluid to the priming chamber of the fire protection system valve to thereby open the fire protection valve; and a discharge outlet, said priming line discharging the priming fluid to the discharge outlet when said component redirects the flow of priming fluid away from said outlet of said priming line; and said inlet and said outlet of said priming line and said discharge outlet provided at said mounting member.

2. The trim assembly according to claim 1, wherein said component comprises a solenoid valve.

3. The trim assembly according to claim 2, wherein said input comprises a control signal from a control panel.

4. The trim assembly according to claim 3, further comprising at least one fire detector, said control panel detecting when said fire detector detects a fire and generating said control signal in response to said fire detector detecting a fire.

5. The trim assembly according to claim 4, wherein said fire detector comprises a normally open fire detector.

6. The trim assembly according to claim 2, wherein said solenoid valve comprises a normally closed solenoid valve.

7. The trim assembly according to claim 4, wherein said component further comprises an actuator.

8. The trim assembly according to claim 7, wherein said actuator is in communication with the sprinkler system piping, said actuator redirecting priming fluid away from said outlet of said priming line when said actuator detects a drop in the sprinkler system piping and said solenoid valve is opened by said control panel.

9. The trim assembly according to claim 8, wherein said piping assembly includes an inlet for coupling said actuator to said sprinkler system piping.

10. The trim assembly according to claim 9, wherein said actuator comprises a pneumatic actuator.

11. The trim assembly according to claim 10, further comprising a pressure operated valve, said pressure operated valve providing a hydraulic latch for the fire protection system valve.

12. The trim assembly according to claim 11, wherein said pressure operated valve is in communication with the inlet of the fire protection system valve, said pressure operated valve closing communication between said inlet and said outlet of said priming line when sensing the system valve is open to thereby latch the system valve open.

13. The trim assembly according to claim 1, wherein trim piping includes at least one alarm connection for connecting to an external alarm device.

14. The trim assembly according to claim 13, wherein said alarm connection is provide generally at said mounting member.

15. The trim assembly according to claim 1, wherein said mounting member comprises an enclosure, said enclosure includes a removable cover to provide access to said trim piping assembly in said enclosure.

16. The trim assembly according at claim 1, wherein said component comprises an pneumatic actuator, said pneumatic actuator in communication with the pressure in the sprinkler system piping, and said pneumatic actuator redirecting the flow of priming fluid away from the outlet of the priming line when detecting a drop in pressure in the sprinkler system piping.

17. The trim assembly according to claim 16, wherein said piping assembly includes an inlet connection for communicating between said pneumatic actuator and the sprinkler system piping, said inlet connection provided at said mounting member.

18. The trim assembly according to claim 16, further comprising a pressure controlled valve, said pressure controlled valve in communication with the inlet pressure of the system valve, said pressure controlled valve closing communication between said inlet and said outlet of said priming line when detecting an increase in pressure in the inlet of the system valve to thereby latch the system valve open.

19. The trim assembly according to claim 18, wherein said piping assembly has an inlet connection for communication between said pressure control valve and the inlet of the system, said inlet connection provided at said mounting member.

20. A fire protection system comprising:

a fire suppressant fluid supply;

sprinkler system piping;

a fire protection system valve having an inlet in communication with said fire suppressant fluid supply and an outlet in communication with said sprinkler system piping, said fire protection valve having a priming chamber and a clapper assembly, said clapper assembly closing communication between said inlet of said valve and said outlet of said valve when said priming chamber is pressurized, and said clapper assembly opening communication between said inlet of said valve and said outlet of said valve when said priming chamber is depressurized to control the flow of fire suppressant fluid from said fire suppressant fluid supply to said sprinkler system piping; and a trim assembly comprising:

a mounting member; and a piping assembly mounted to said mounting member, said piping assembly comprising: a priming line having an inlet receiving priming fluid from said fire suppressant fluid supply line and an outlet for delivering priming fluid to said priming chamber of said fire protection system valve; a component responsive to one input chosen from a control signal and a pressure differential, said component controlling the flow of fire suppressant from said inlet to said outlet of said priming line in response to said input for controlling the delivering of priming fluid to said priming chamber of said fire protection system valve to thereby open said control valve; and a discharge outlet, said priming line discharging the priming fluid to said discharge outlet when said component redirects the flow of fire suppressant fluid away from said priming line.

21. The fire protection system according to claim 20, wherein said mounting member comprises an enclosure, said enclosure including an enclosure wall, said inlet and outlet of said priming line and said discharge outlet provided at said enclosure wall.

22. The fire protection system according to claim 20, further comprising a control panel, said control panel in communication with a detector, said component comprising a solenoid valve, said control panel actuating said solenoid valve in response to said detector detecting a fire condition.

23. The fire protection system according to claim 22, wherein said solenoid valve comprises a normally closed solenoid valve.

24. The fire protection system according to claim 23, wherein said component further comprises a pneumatic actuator, said pneumatic actuator valve in communication with said sprinkler system piping and being responsive to a pressure differential in the sprinkler system piping, said pneumatic actuator redirecting the flow of priming fluid away from said outlet of said priming line when the pressure drops in the sprinkler system piping and said solenoid valve is opened.

25. The fire protection system according to claim 24, further comprising a shut-off valve, said shut-off valve in communication with an inlet of the system valve, said shut-off valve closing communication between said inlet and said outlet of said priming line in response to detecting flow through the system valve to thereby latch the system valve closed.

26. The fire protection system according to claim 25, wherein said shut-off valve a pressurized shut-off valve.

27. The fire protection system according to claim 20, wherein trim piping includes at least one alarm connection for connecting to an external alarm device.

28. The fire protection system according to claim 27, wherein said alarm connection is provided generally at said enclosure wall.

29. The fire protection system according to claim 21, wherein said enclosure includes a removable cover to provide access to said trim piping in said enclosure.

30. A trim assembly for a fire protection system valve, the fire protection system valve having an inlet in communication with a fire suppressant fluid supply line and an outlet in communication with sprinkler system piping, the fire protection valve system having a priming chamber and a clapper assembly, the clapper assembly closing communication between the inlet and the outlet when the priming chamber is pressurized and the clapper assembly opening communication between the inlet and the outlet when the priming chamber is depressurized to control the flow of fire suppressant fluid from the fire suppressant fluid supply line to the sprinkler system piping, said trim assembly comprising:

an enclosure having an enclosure wall;

a piping assembly in said enclosure, said piping assembly comprising:

a priming line having an inlet for receiving priming fluid from the fire suppressant fluid supply line and an outlet for delivering priming fluid to the priming chamber of the fire protection system valve, said inlet and said outlet provided at said enclosure wall;

a component responsive to one input chosen from a control signal and a pressure differential, said component controlling the flow of priming fluid between said inlet and said outlet of said priming line in response to said input for controlling the delivering of priming fluid to the priming chamber of the fire protection system valve to thereby open the fire protection valve; and a discharge outlet, said priming line discharging the priming fluid to the discharge outlet when said component directs priming fluid away from said outlet of said priming line, said discharge outlet provided at said enclosure wall; and a shut-off valve in communication with said priming line and for communicating with an inlet of the system valve, said shut-off valve closing communication between said inlet and said outlet of said priming line when detecting flow in said system valve to thereby latch the system valve open.

31. The trim assembly according to claim 30, wherein said component comprises a solenoid valve.

32. The trim assembly according to claim 31, wherein said solenoid valve comprises a normally closed solenoid valve.

33. The trim assembly according to claim 30, wherein said component comprises a pneumatic actuator.

34. The trim assembly according to claim 33, wherein said pneumatic actuator is in communication with a connection inlet for coupling to the sprinkler system piping, said pneumatic actuator opening when said pneumatic detects a pressure drop in the sprinkler system.

35. The fire protection system according to claim 30, further comprising a control panel and a detector, said component comprising a solenoid valve, said solenoid valve actuated by said control panel in response to said detector detecting a fire condition.

36. The fire protection system according to claim 35, wherein said solenoid valve comprises a normally closed solenoid valve, said control panel actuating said solenoid valve to open in response to said detector detecting a fire condition.

* * * * *